United States Patent [19]

Holm et al.

[11] Patent Number: 4,491,052

[45] Date of Patent: Jan. 1, 1985

[54] PROCESS FOR THE MANUFACTURE OF KNOTLESSLY BRAIDED NETS

[75] Inventors: Wilfried Holm; Jürgen Kloos; Gerhard Nätke, all of Rostock, German Democratic Rep.

[73] Assignee: Institut für Hochseefischerei und Fischverarbeitung, Rostock, German Democratic Rep.

[21] Appl. No.: 332,044

[22] Filed: Dec. 18, 1981

[30] Foreign Application Priority Data

Mar. 25, 1981 [DD] German Democratic Rep. ... 228563
Apr. 28, 1981 [DD] German Democratic Rep. ... 229540
Jul. 13, 1981 [DD] German Democratic Rep. ... 231680

[51] Int. Cl.[3] ..... D04C 1/00; D04C 5/00
[52] U.S. Cl. ..... 87/3; 87/24
[58] Field of Search ..... 87/3–5, 87/24–28, 33

[56] References Cited

U.S. PATENT DOCUMENTS

| | | | |
|---|---|---|---|
| 966,137 | 8/1910 | Storey | 87/3 |
| 976,946 | 11/1910 | Storey | 87/24 |
| 1,606,059 | 9/1926 | Corson | 87/24 |
| 1,975,212 | 10/1934 | Kobayashi | 87/24 |
| 1,975,431 | 10/1934 | Okuma | 87/24 |
| 2,357,308 | 9/1944 | Boulais | 87/24 |
| 3,714,862 | 2/1973 | Berger | 87/8 |
| 3,866,512 | 2/1975 | Berger | 87/24 X |
| 3,894,470 | 7/1975 | Reichel | 87/24 |

FOREIGN PATENT DOCUMENTS

| | | |
|---|---|---|
| 49967 | 9/1966 | German Democratic Rep. . |
| 43176 | 11/1970 | German Democratic Rep. . |
| 86061 | 11/1971 | German Democratic Rep. . |
| 103282 | 1/1974 | German Democratic Rep. . |
| 30922 | 10/1975 | German Democratic Rep. . |
| 137606 | 9/1979 | German Democratic Rep. . |

*Primary Examiner*—John Petrakes
*Attorney, Agent, or Firm*—Jordan and Hamburg

[57] ABSTRACT

The present invention is directed to a method for fabricating three, four, six, or eight-threaded knotlessly woven nets, which involves aligning at least a plurality of flyer wheels to form a braiding head, and then positioning two such braiding heads against one another. Bobbins are then positioned on recesses formed at discrete intervals along the circumference of said flyer wheels, and the bobbins are then rotated about said flyer wheels in figure-eight shaped fashion to weave a net shank. Then, the bobbins are rotated between the braiding heads in figure-eight shaped fashion to form a connection point between the net shanks.

12 Claims, 106 Drawing Figures

FIG. 2(,A)

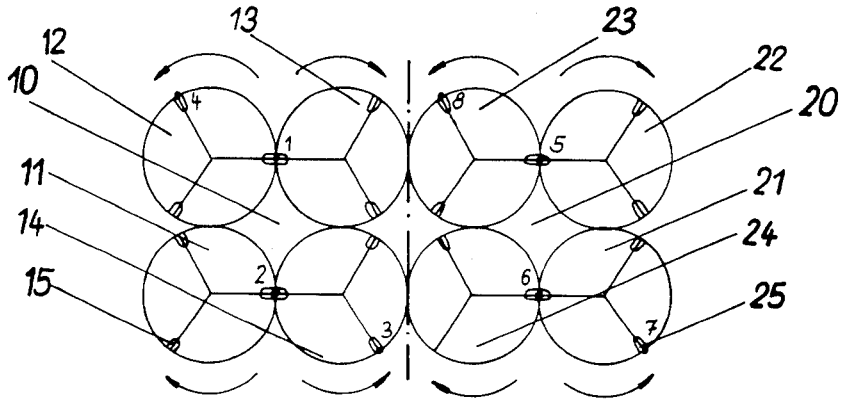
FIG. 5(A)
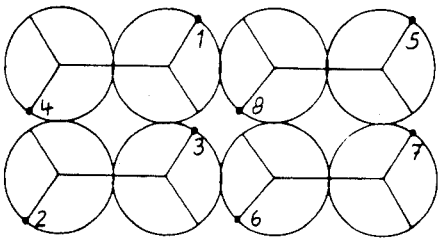
FIG. 5(B)
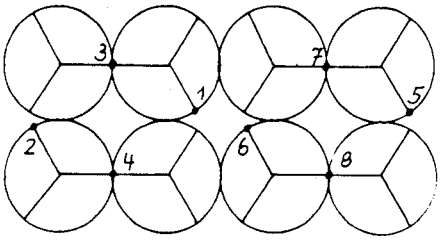
FIG. 5 (C)
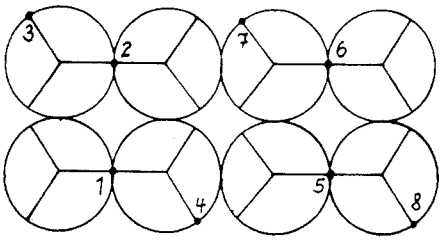
FIG. 5(D)
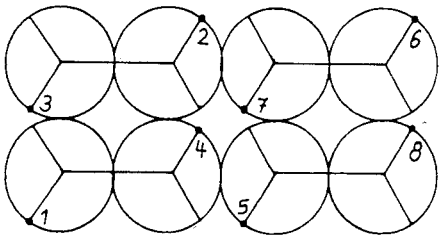
FIG. 5(E)
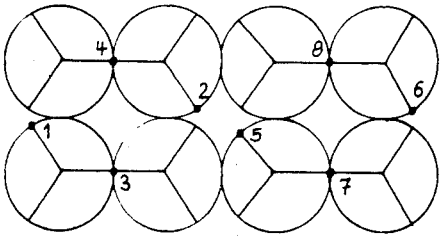
FIG. 5(F)
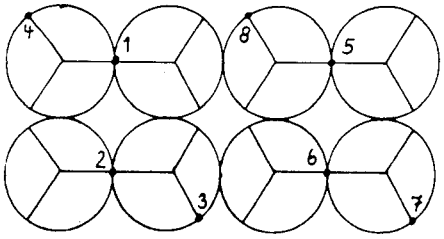
FIG. (G)

PROCESS FOR THE MANUFACTURE OF KNOTLESSLY BRAIDED NETS

BACKGROUND OF THE INVENTION AND PRIOR ART STATEMENT

This invention relates to a process for the manufacture of knotlessly braided nets according to the quadruple flyer wheel principle, in which the net mesh forming the net shanks comprises three, four, six or eight threads. The knotlessly braided net is used especially in the manufacture of fishing devices.

The so-called quadruple flyer wheel principle for the manufacture of four-threaded, knotlessly braided nets is known from DD-PS Nos. 30922, 43176 and 86061. It is characterized by the fact that a multiplicity of braiding heads are provided next to each other for the manufacture of four-threaded net shanks, which in each case comprises four squarely arranged flyer wheels. Manufacture of the net shanks on each braiding head is carried out by rotation of four bobbins diagonally arranged towards each other in figure 8-shaped paths. The flyer wheels are provided with four rectangularly arranged recesses for receiving and transporting the bobbins.

Shunts are provided between the flyer wheels of adjoining braiding heads to produce the connection point between adjoining, four-threaded net shanks, over which passage of the bobbins from one braiding head to the adjoining one is accomplished.

In view of the arrangement and the number of flyer wheels in the quadruple flyer wheel principle, as well as the formation of the flyer wheels with four recesses, eight steps or 90° revolutions of the flyer wheels are necessary to manufacture one braid in the shank. The same number of steps is necessary to manufacture the connection point.

An arrangement for the manufacture of four-threaded, knotlessly braided nets (DD-PS No. 103 282) has been known, in which the individual braiding heads for the manufacture of the net shanks comprise three flyer wheels (triple flyer wheel principle). Manufacture of the net shank on a braiding head is accomplished by rotating four bobbins, arranged in pairs vis-a-vis each other, according to a predetermined plan. Each flyer wheel has four 90°-spaced recesses for the bobbins.

In view of the arrangement and the number of flyer wheels under the triple flyer wheel principle, the manufacture of one braid in a squarely cord-shaped net shank requires twelve steps or 90° turns of the flyer wheels. The connection point between two net shanks can be manufactured in three steps.

An arrangement and a method for the manufacture of three-threaded knotlessly braided nets has been further known (DD-PS No. 49967). Each of the flyer wheels has three recesses arranged at angles of 120° for receiving the bobbins (120° separation of the flyer wheels).

The disadvantages of this braiding arrangement are that three 120° revolutions of the flyer wheels are necessary to manufacture the connection point, such connection point considered far from ideal in the physical-textile sense.

Finally, DD-PS No. 137 606 discloses an arrangement, including a method for the manufacture of a six-threaded, knotlessly braided net. The net is characterized by the fact that each net shank comprises two adjoining, triple-threaded, plaited nettings, in which at each connection point each triple-threaded netting of one net shank crosses each triple-threaded netting of the other net shank. Manufacture of the net is carried out on a braiding maching wherein each braiding head comprises four flyer wheels and each flyer wheel has three recesses arranged at angles of 120°.

The disadvantage of this net is that braiding of all the six threads does not occur in the net shank.

The object of this invention is to simplify the technical method for the manufacture of three, four, six and eigth-threaded, knotlessly braided nets according to the quadruple flyer wheel principle and to eliminate the physical-textile shortcomings of known knotlessly braided nets.

SUMMARY OF THE INVENTION

The invention has the object of creating a method for the manufacture of knotlessly braided nets based on the quadruple flyer wheel principle, that is less costly and less technically complicated for the manufacture of net shanks and connection points, provided that the square cord form of the net shanks, as well as the path of the bobbins which has been predetermined through the braiding of the net shanks, is maintained on manufacture of the connection point.

The method of this invention for manufacture of knotlessly braided nets according to the quadruple flyer wheel principle, in which the net shanks forming the net mesh comprise three, four, six or eight threads, is characterized by the fact that manufacture of the net shanks is carried out by paths formed by the flyer wheels of the individual braiding heads that diagonally cross each other and that the connection point of the net shanks is produced at the passage of the bobbins over shunts provided between the flyer wheels of adjoining braiding heads.

Manufacture of the three-threaded net shanks occurs in the figure 8-shaped paths formed by two flyer wheels per braiding head, in which the flyer wheels are provided with four recesses at 90° angles for the bobbins, and that to produce the connection point, one begins with bobbin positions concentrated in the recesses between flyer wheels of adjoining braiding heads, in which creation of the connection point is accomplished after two 90° turns of the flyer wheels.

Manufacture of the four-threaded net shanks occurs in the figure 8-shaped paths formed by four squarely arranged flyer wheels per braiding head, in which the flyer wheels are provided with recesses arranged at 120° angles for the bobbin pairs, the figure 8-shaped paths of each braiding head that diagonally cross each other are formed by the flyer wheels that are diagonally opposite and a pair of bobbins revolves in each figure 8-shaped path.

Manufacture of the six-threaded net shank occurs in figure 8-shaped paths formed by four squarely arranged flyer wheels per braiding head, in which the flyer wheels are either provided with four recesses at angles of 90° or with three recesses at angles of 120° for the bobbin pairs, and in which one pair of bobbins revolves in a path formed by the flyer wheels and the two remaining bobbin pairs revolve in a path that diagonally crosses the first path.

A final feature of the invention is that creation of the connection point is accomplished by shifting the bobbin pairs to the flyer wheel of the adjoining braiding head corresponding to the respective individual bobbin pairs, after manufacture of the eight-threaded net shank in the figure 8-shaped paths formed by the four squarely arranged flyer wheels per braiding head, in which the flyer wheels are provided with four recesses at angles of 90° for the bobbin pairs.

This invention makes it possible to simplify the technical process for the manufacture of the connection point of three-threaded, knotlessly braided nets, in which the physical-textile qualities of the connection point are improved at the same time.

Concerning the four-threaded net, utilization of the quadruple flyer wheel principle as opposed to the triple flyer wheel principle is an advantage because less steps are required for the manufacture of the braid in the net shank, in combination with a reduction of steps in the production of the connection point from eight to five steps.

Another advantage of the proposed method for the manufacture of four-threaded nets is that only three recesses are necessary for receiving and transporting the bobbins. (Previously four recesses per flyer wheel in the quadruple flyer wheel principle were all that were known.) Due to the smaller technical requirements per flyer wheel, the possibility arises of utilizing larger spools with a higher capacity.

In view of the production of six-threaded, knotlessly braided nets, the invention makes it possible to manufacture a compact, cord-formed netting mesh.

By utilizing the proposed method for the manufacture of eight-threaded, knotlessly braided nets, it is possible to make the connection point compact, symmetrical and with advantageous physical-textile properties, whereby the sturdiness of the net, for instance as cod end material of dragnets, is substantially improved.

BRIEF DESCRIPTION OF THE DRAWINGS

The invention is described in more detail in the next paragraphs with reference to the drawings.

FIGS. 2(A)–(I) illustrate two adjoining braiding heads and step-by-step manufacture of the adjoining net shank;

FIGS. 5(A)–(G) illustrate two adjoining braiding heads and the steps toward manufacture of adjoining four-threaded net shanks;

DETAILED DESCRIPTION OF PREFERRED EMBODIMENTS

Figure 2B:
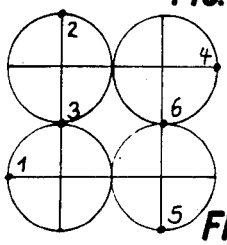
Figure 2C:
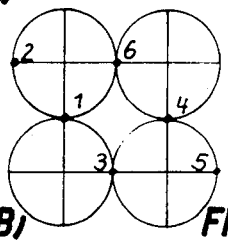
Figure 1D:
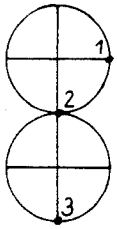
Figure 1E:
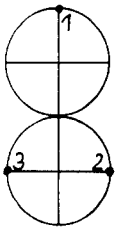
Figure 2D:
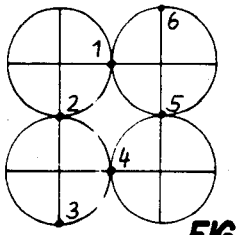
Figure 2E:
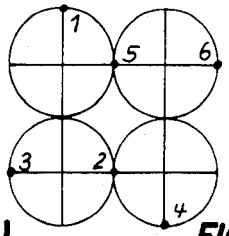
Figure 1F:
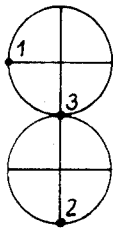
Figure 1G:
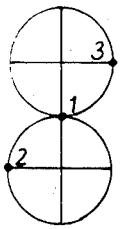
Figure 2F:
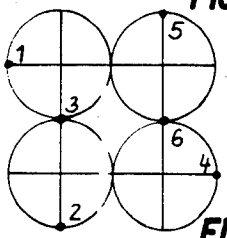
Figure 2G:
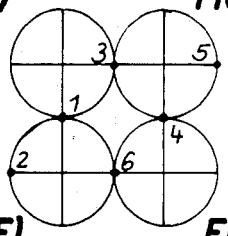
Figure 1H:
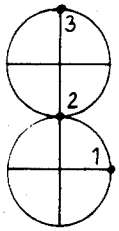
Figure 1I:
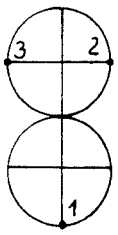
Figure 2H:
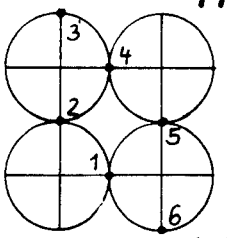
Figure 2I:
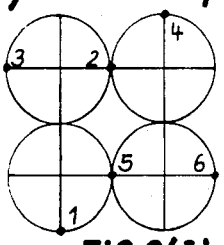
Figure 3A:
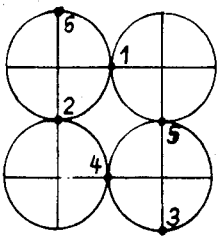
FIGS. 3(A)–(B) illustrate step-by-step manufacture of the connection point of two adjoining net shanks.
Figure 3B:
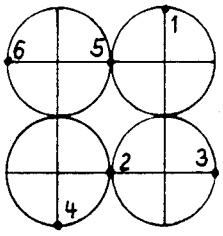

FIGS. 1 to 3 relate to the manufacture of three-threaded, knotlessly braided nets.

Figure 1A:
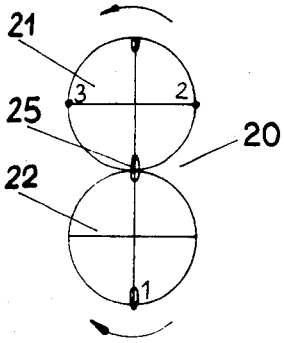
FIGS. 1(A)–(I) illustrate a braiding head and step by-step manufacture of a three-threaded net shank.
Figure 1B:
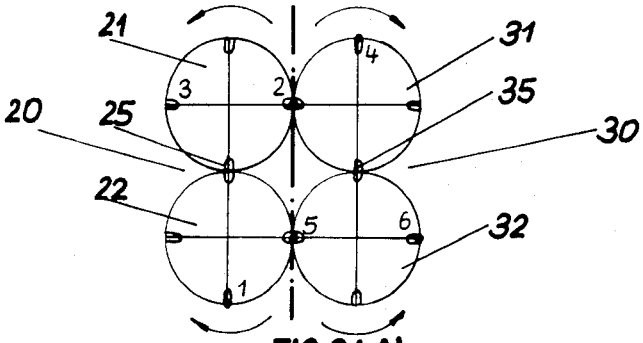
Figure 1B:
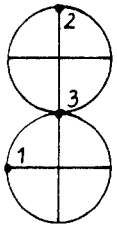
Figure 1C:
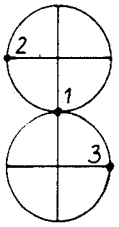

FIG. 1(A) illustrates the braiding head 20 for the manufacture of a three-threaded net shank. The braiding head 20 comprises the flyer wheels 21 and 22, each provided with four recesses 25 arranged at 90° angles for receiving and transporting bobbins 1 to 3. The bobbins 1 to 3 revolve in the figure 8-shaped path formed by the flyer wheels 21 and 22. The turning direction of the flyer wheels is marked by arrows.

FIGS. 1(B)–(I) illustrate the step-by-step preparation of the net shank by 90° revolutions of the two flyer wheels 21 and 22. Bobbins 1 to 3 are again in their starting positions after eight steps, in other words, a braid is produced in the net shank after eight steps.

FIG. 2(A) illustrates a braiding unit comprising braiding heads 20 and 30. The braiding heads border on each other with their flyer wheels 21 and 22 or 31 and 32. FIGS. 2(B)–(I) illustrate step-by-step production of the two net shanks by eight 90° revolutions of the flyer wheels.

FIG. 3 relates to the production of the connection point between adjoining net shanks. For manufacture of the connection point, it will be feasible to start with positions of the bobbins 1 to 3 and 4 to 6 concentrated in the recesses 25 or 35 between the flyer wheels of adjoining braiding heads. The most feasible starting position for the passage of the bobbins for manufacture of the connection point is illustrated in the partial FIG. 2(C). From the step-by-step illustration of the connection point according to FIG. 3 (*a, b*), it can be seen that the connection point is completed after two 90° revolutions of the flyer wheels, after which manufacture of the net shank can be started again.

In contrast to the known principle for manufacture of three-threaded, knotlessly braided nets, in which the flyer wheels of the braiding heads are provided with recesses arranged at 120° angles, the method according to this invention distinguishes itself by reducing the steps for manufacture of the connection point from three 120° revolutions to two 90° revolutions of the flyer wheels. In addition, the method proposed by the present invention results in more advantageous physical-textile qualities.

Figure 4A:
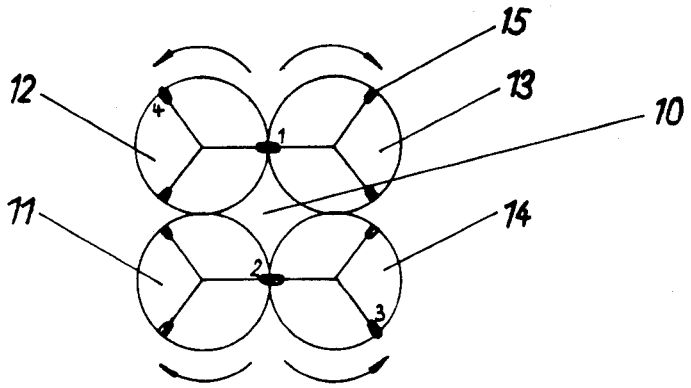
FIGS. 4(A)–(G) illustrate braiding head and the steps toward manufacture of one braid for a four-threaded net shank.
Figure 4B:
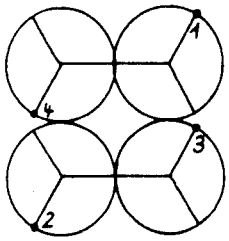
Figure 4C:
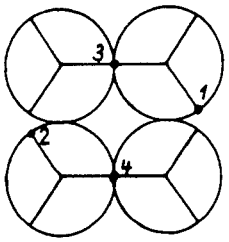
Figure 4D:
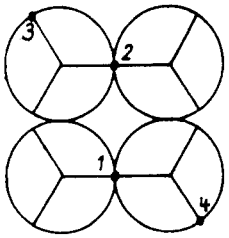
Figure 4E:
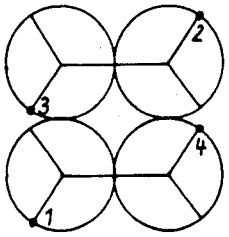
Figure 4F:
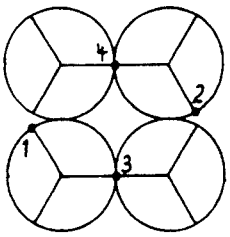
Figure 4G:
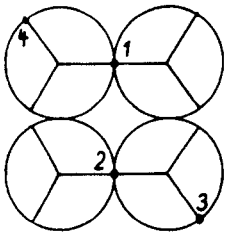
Figure 6A:
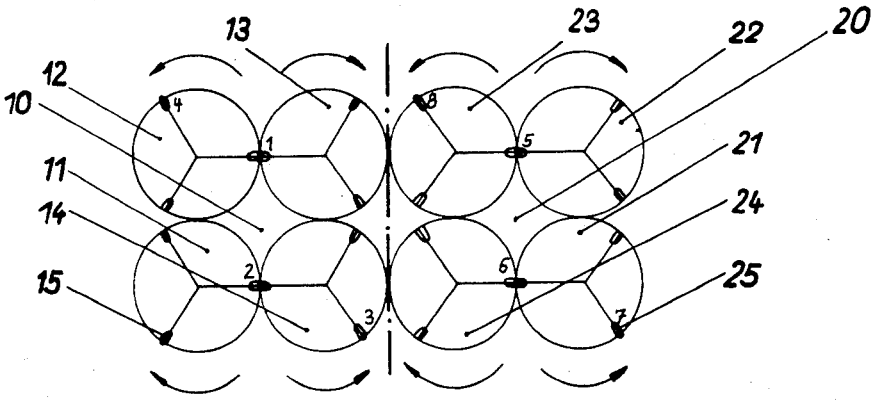
FIGS. 6(A)–(F) illustrate two adjoining braiding heads and the steps toward manufacture of the connection point between the adjoining net shanks.
Figure 6B:
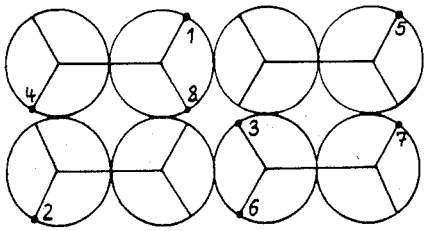
Figure 6C:
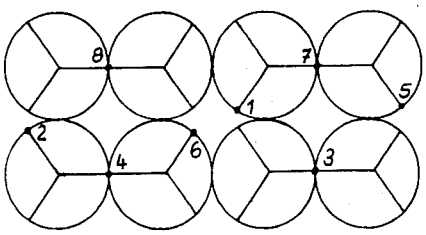
Figure 6D:
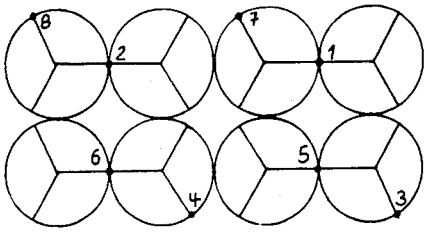
Figure 6E:
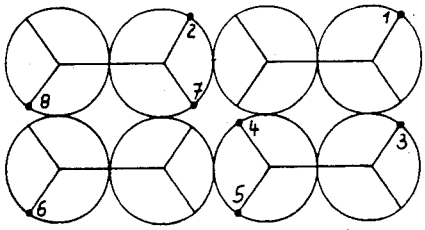
Figure 6F:
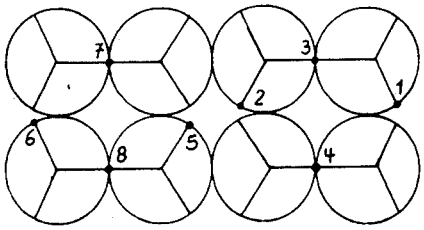

FIG. 4(A) illustrates the braiding head 10 which comprises squarely arranged flyer wheels 11, 12, 13 and 14. Each flyer wheel has three recesses 15 arranged at 120° angles, over which the receiving and the transporting of bobbins 1 to 4 is accomplished. Bobbins 1 and 2 revolve in the figure 8-shaped path formed by flyer wheels 11 and 13, while bobbins 3 and 4 revolve in the path formed by flyer wheels 12 and 14. By the diagonal crossing of the threads revolving with the bobbins, the so-called square cord is produced. The direction of revolution of flyer wheels 11 to 14 is marked by arrows.

FIGS. 4(B)–(G) represent the steps, i.e. 120° revolutions of the flyer wheels for manufacture of the net shank. After six steps, a braid is produced in the net shank and the bobbins have reassumed their initial position.

In contrast to the known quadruple flyer wheel principle, the proposed principle distinguishes itself by the fact that the smaller number of recesses per flyer wheel results in longer traverses and thereby in increased operating velocities.

FIG. 5 represents a braiding unit that comprises two braiding heads 10 and 20. The braiding heads are arranged adjacent one another in such a way that, in each case, two flyer wheels 13, 14 and 23, 24 contact adjoining braiding heads.

FIGS. 5(B)–(G) represent the manufacture, step-by-step, of two adjoining net shanks through six 120° revolutions of the flyer wheels.

FIG. 6 illustrates the manufacture of the connection point of two adjoining net shanks. The starting position of the bobbins in FIG. 6(A) corresponds to the starting position of the bobbins in the upper portion of FIG. 5(A). The transfer of the bobbins from one braiding head to the adjoining braiding head occurs in the figure 8-shaped paths formed by the flyer wheels. From the step-by-step representation in FIGS. 6(B) to 6(F), it can be seen that manufacture of the connection point is completed after five steps and that the sixth step already represents the first step toward the subsequent manufacture of the net shanks.

The advantage of producing the connection point according to the principle proposed in this invention is that the number of steps for the manufacture of the connection point is reduced from eight to five, as opposed to the known quadruple flyer wheel principle.

Figure 7A:
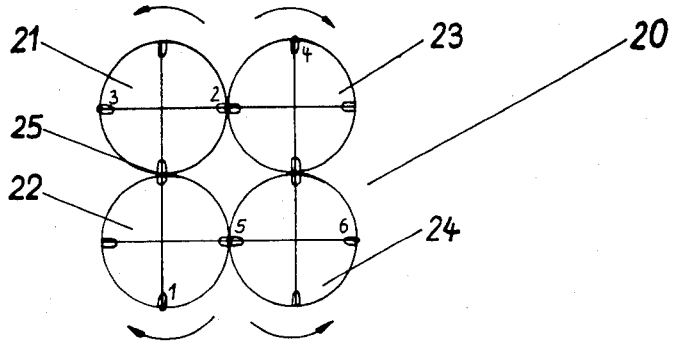
FIGS. 7(A)–(I) illustrate braiding head wheel and step-by-step manufacture of a six-threaded net shank.
Figure 7B:
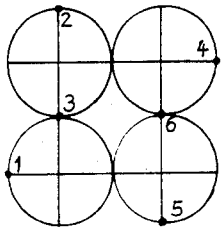
Figure 7C:
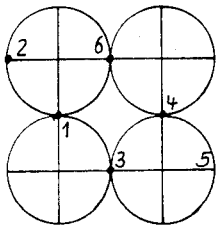
Figure 7D:
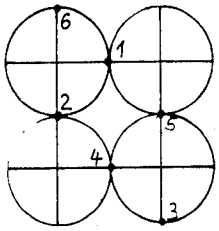
Figure 7E:
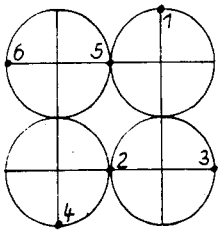
Figure 7F:
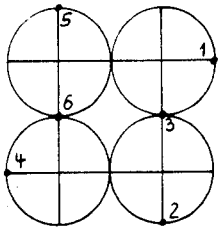
Figure 7G:
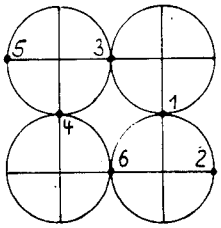
Figure 7H:
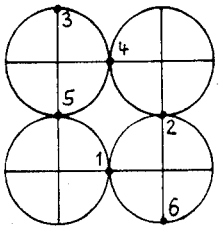
Figure 7I:
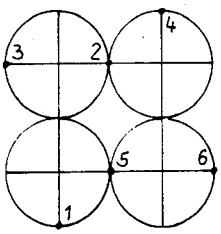

FIG. 7(A) illustrates a braiding head 20 for the manufacture of a six-threaded net shank. The braiding head 20 comprises four ilyer wheels 21 to 24, each provided with four recesses 25 at 90° angles for receiving and transporting bobbins 1 to 6. According to the method proposed by this invention, a pair of bobbins 1, 4 revolve in the figure 8-shaped path formed by the two flyer wheels 22, 23, while two pairs of bobbins 2, 5 and 3, 6 revolve in the figure 8-shaped path formed by the flyer wheels 21, 24 that crosses the first-mentioned path in a diagonal direction. The direction of revolution of the flyer wheels is marked by arrows. FIGS. 4(B)–(I) illustrate the manufacture, step-by-step, of the net shank through 90° revolutions of the flyer wheels 21 to 24. After eight steps, the bobbins 1 to 6 have reassumed their initial position to begin manufacture of a new braid in the net shank.

Figure 8A:
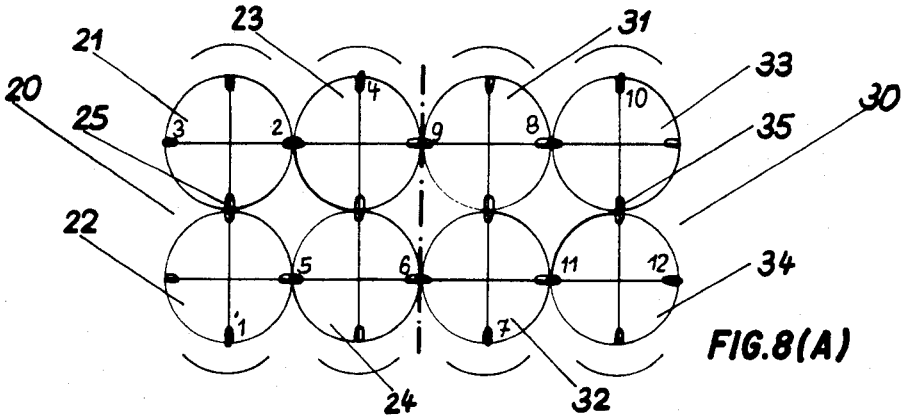
FIGS. 8(A)–(I) illustrate two adjoining braiding heads and the step-by-step manufacture of the adjoining net shanks.
Figure 8B:
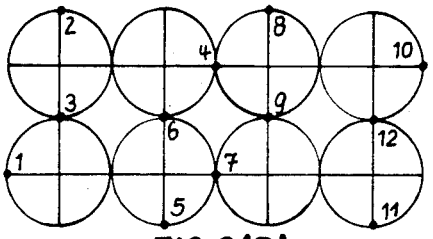
Figure 8C:
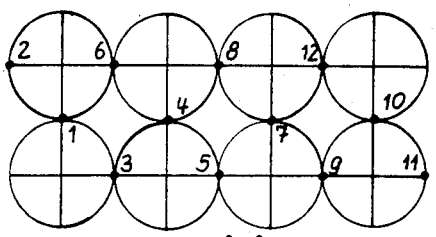
Figure 8D:
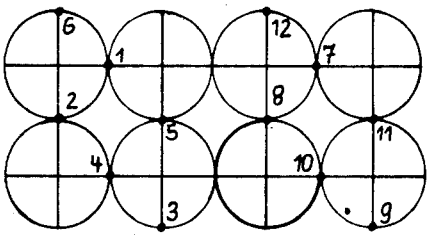
Figure 8E:
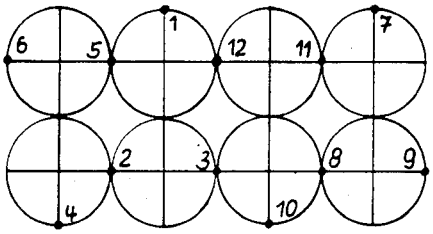
Figure 8F:
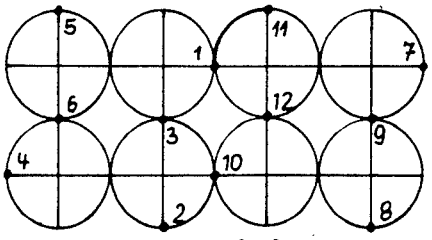
Figure 8G:
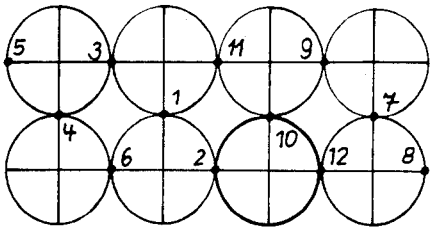
Figure 8H:
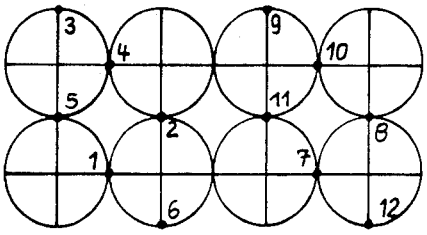
Figure 8I:
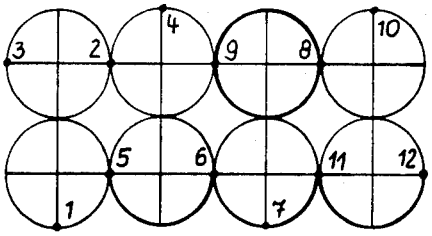
Figure 9A:
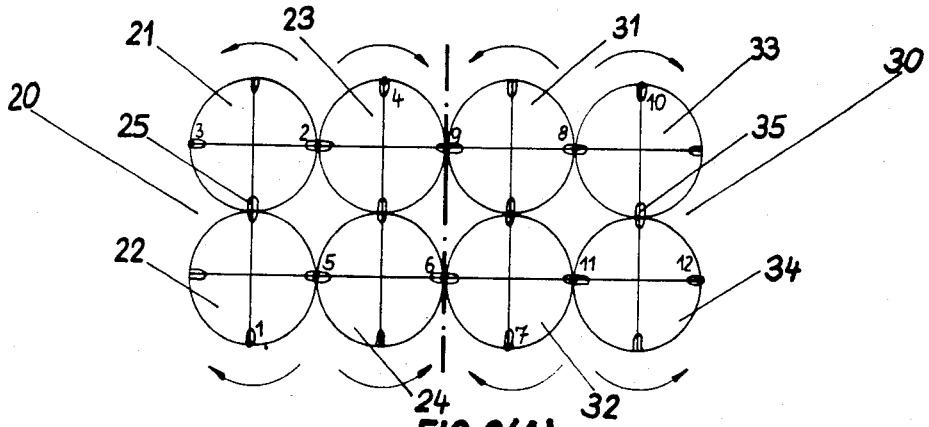
FIGS. 9(A)–(I) illustrate step-by-step manufacture of the connection point of two adjoining net shanks.
Figure 9B:
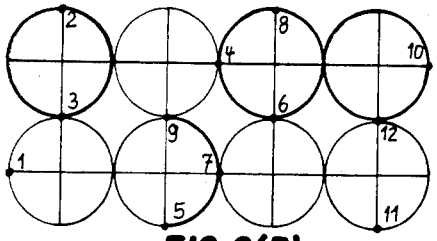
Figure 9C:
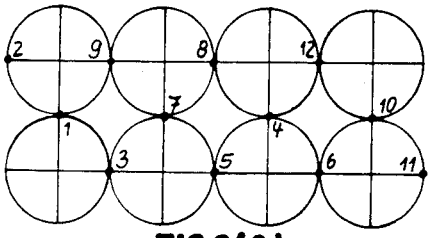
Figure 9D:
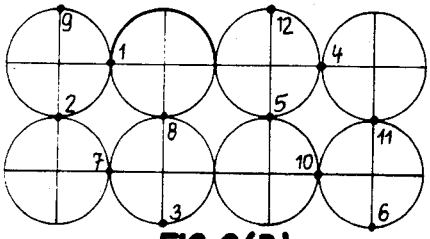
Figure 9E:
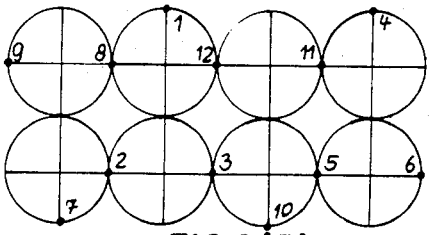
Figure 9F:
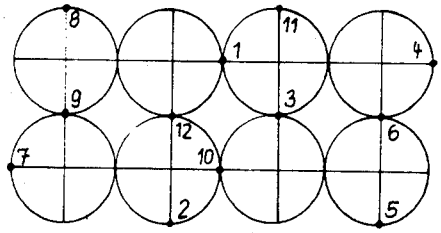
Figure 9G:
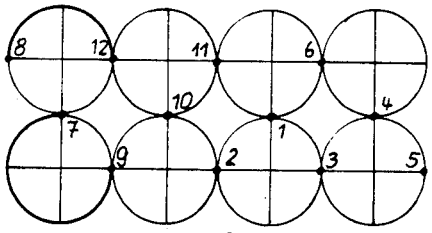
Figure 9H:
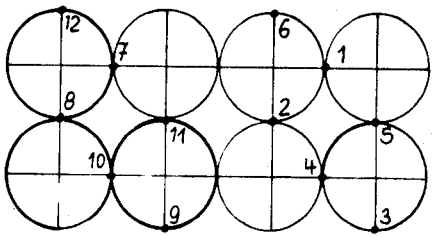
Figure 9I:
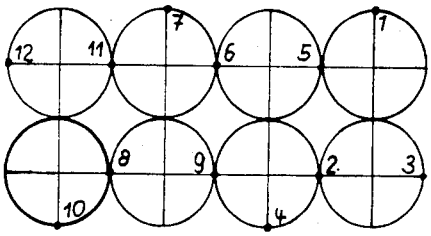
Figure 10A:
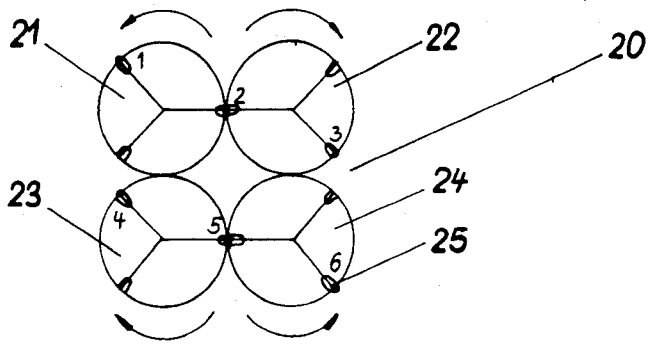
FIGS. 10(A)–(G) illustrate braiding head and the step-by-step manufacture of a six-threaded net shank.
Figure 10B:
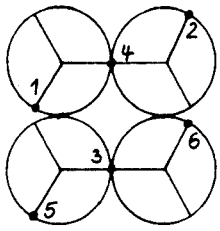
Figure 10C:
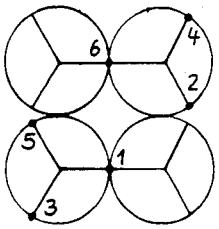
Figure 10D:
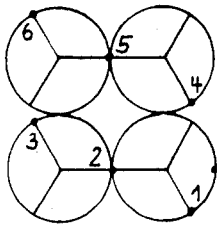
Figure 10E:
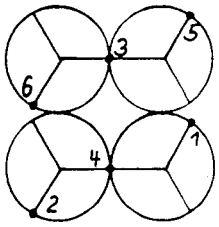
Figure 10F:
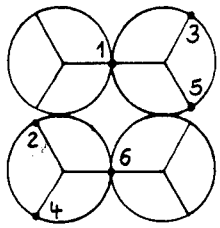
Figure 10G:
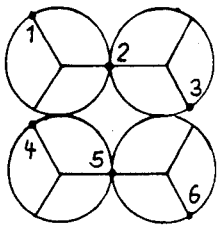
Figure 11A:
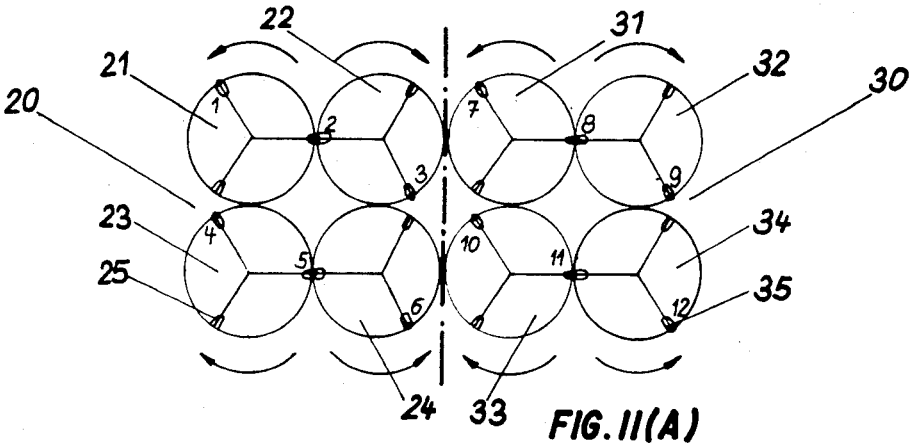
FIGS. 11(A)–(G) illustrate two adjoining braiding heads in the step-by-step manufacture of adjoining net shanks.
Figure 11B:
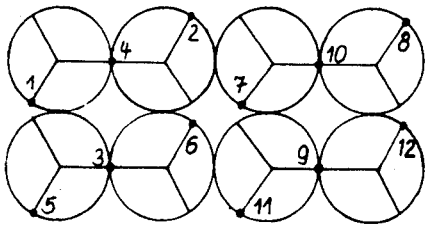
Figure 11C:
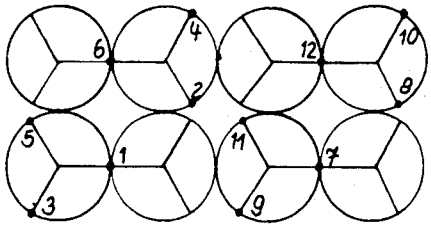
Figure 11D:
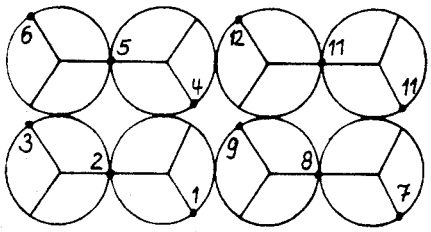
Figure 11E:
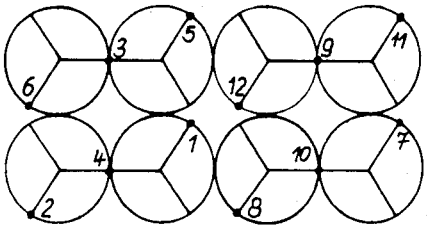
Figure 11F:
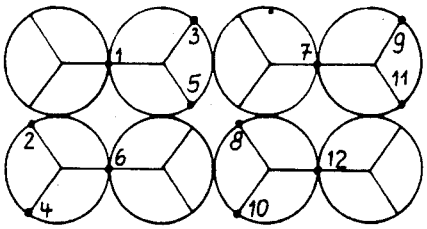
Figure 11G:
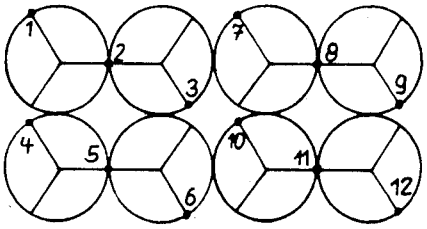
Figure 12A:
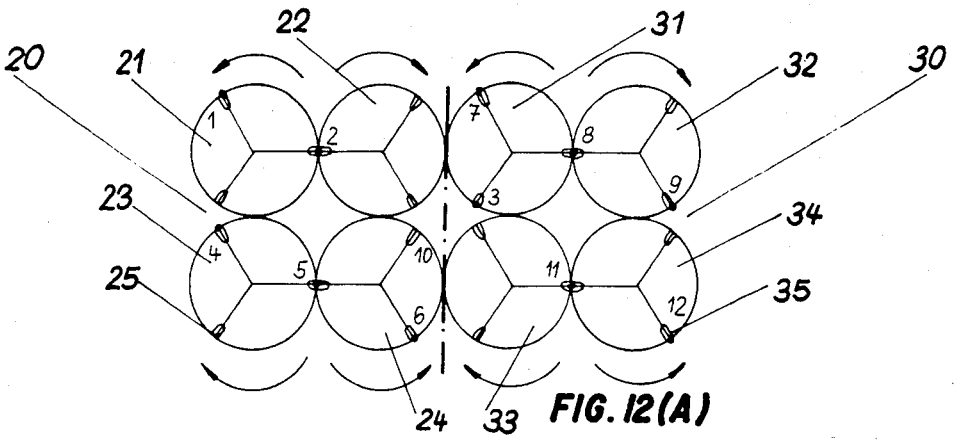
FIGS. 12(A)–(G) illustrate step-by-step manufacture of the connection point of two adjoining net shanks.
Figure 12B:
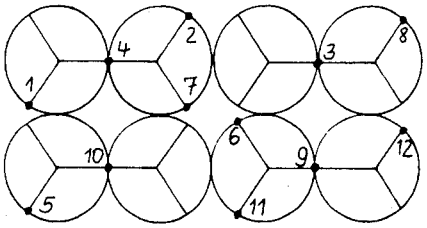
Figure 12C:
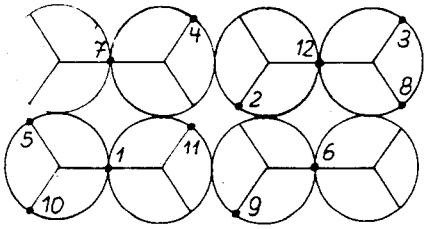
Figure 12D:
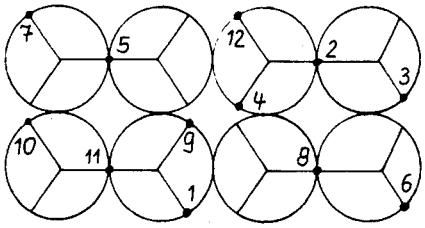
Figure 12E:
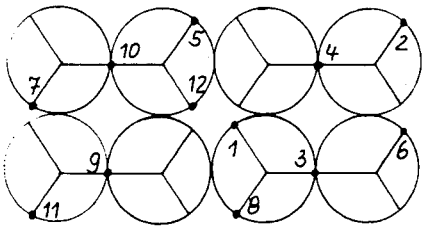
Figure 12F:
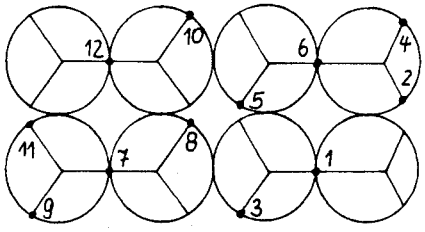
Figure 12G:
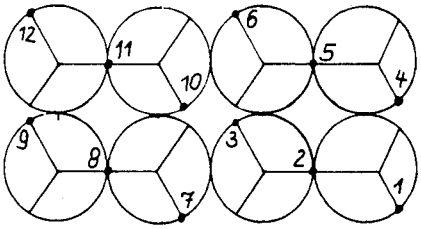

FIG. 8(A) illustrates a braiding unit formed of the two braiding heads 20 and 30. Braiding head 20 comprises the flyer wheels 21 to 24, and braiding head 30 comprises the flyer wheels 31 to 34. The braiding heads are arranged adjacent one another in such a way that, in each case, two flyer wheels 23, 24 and 31, 32 adjoin each other. FIGS. 8(B)–(I) illustrate the manufacture, step by step, of the two net shanks through eight 90° turns of the flyer wheels.

FIG. 9 represents the manufacture of the connection point between two adjoining net shanks. For manufacture of the connection point, it will be feasible to start with the position of the bobbins corresponding to the initial position for manufacture of the net shanks. The bobbins 1 to 6 and 7 to 12 switch over to figure 8-shaped paths that run in a diagonal direction between the braiding heads 20, 30. From the step-by-step representation of the manufacture of the connection point according to FIGS. 9(B) to 9(I), it can be seen that manufacture of the connection point is already completed after six 90° turns of the flyer wheels (FIG. 9(G)), the two subsequent 90° turns of the flyer wheels illustrated in FIGS. 9(H) and 9(I) already representing the first steps toward manufacture of the new mesh shank.

FIGS. 10 to 12 illustrate the manufacture of a six-threaded, knotlessly braided net. FIG. 10(A) illustrates the braiding head 20 for manufacture of the six-threaded net shank. Braiding head 20, in turn, comprises four flyer wheels 21 to 24, each provided with three recesses 25 arranged at angles of 120° for bobbins 1 to 6. The path of bobbins 1 to 6 corresponds to the bobbin path according to FIG. 7, in which bobbins 1, 4 revolve in the figure 8-shaped path formed by the flyer wheels 21, 24 and the two pairs of bobbins 2, 5 and 3, 6 revolve in the figure 8-shaped path formed by the flyer wheels 22, 23, diagonally crossing the first path. The direction of revolution of the flyer wheels is marked by arrows. FIG. 10(B) to (G) illustrates the manufacture, step-by-step, of the net shank through 120° turns of the flyer wheels. A braid in the net shank is completed after six steps, i.e. six 120° turns of the flyer wheels.

FIG. 11 illustrates the manufacture of two adjoining, six-threaded net shanks on braiding heads 20 and 30. The remaining steps to be taken are those enumerated for FIG. 8. The only difference is that manufacture of the net shanks is completed after six steps, corresponding to the 120° separation of the flyer wheels.

Finally, FIG. 12 again illustrates manufacture of the connection point between two adjoining net shanks. Here the initial position of bobbins 1 to 6 and 7 to 12 will be the same as that at the beginning of manufacture of the net shanks. The switching of the bobbins between the braiding heads 20, 30 occurs in diagonal figure 8-shaped paths. The step-by-step manufacture of the connection points (FIGS. 12(B) to 12(G)) illustrates that the bobbins have switched positions after five 120° turns of the flyer wheels and that the connection point has been produced.

A comparison of the two manufacturing methods illustrated in FIGS. 7 to 9 and FIGS. 10 to 12 for six-threaded, knotlessly braided nets illustrates that both net shanks have the same construction, expenditures in setup for manufacturing the connection point in the method according to FIG. 9, being, however, less than of the method according to FIG. 12, i.e. six 90° turns, as compared to five 120° turns.

Figure 13A:
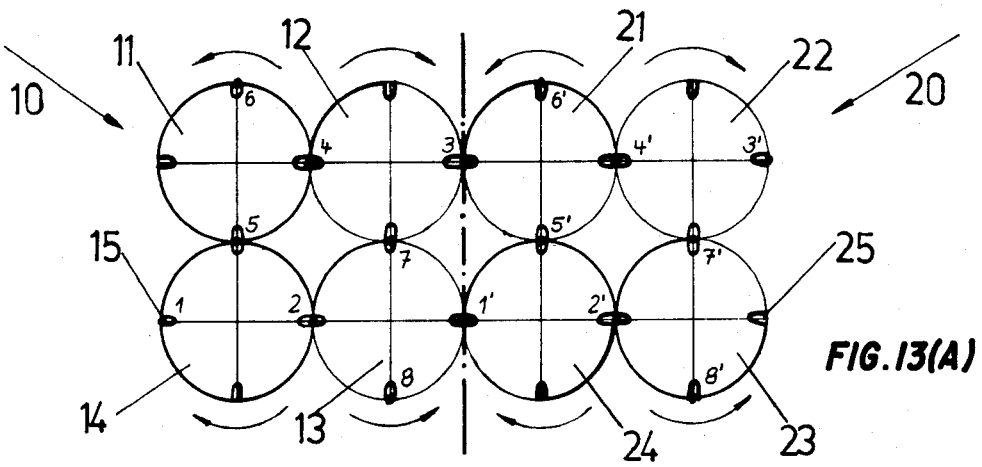
FIGS. 13(A)–(I) illustrate a braiding unit comprising two braiding heads and the step-by-step manufacture of the eight-threaded net shanks.
Figure 13B:
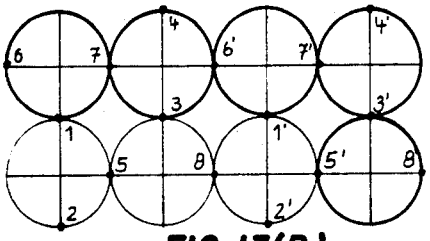
Figure 13C:
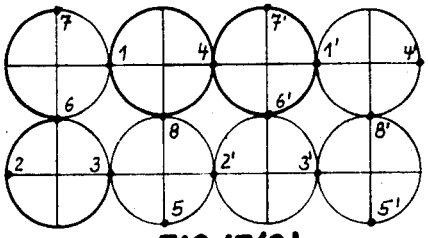
Figure 13D:
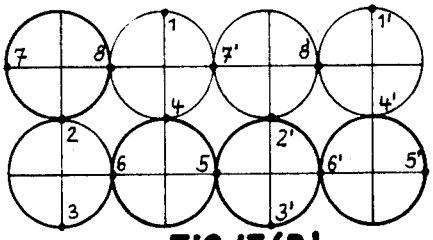
Figure 13E:
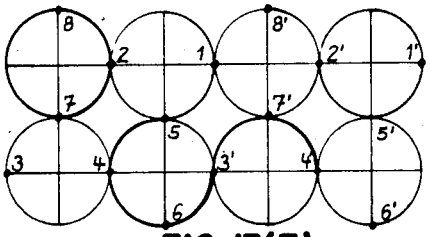
Figure 13F:
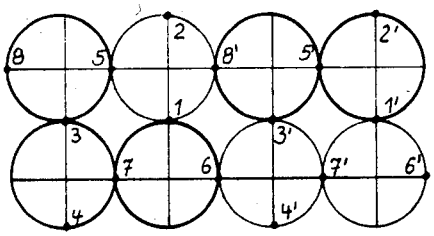
Figure 13G:
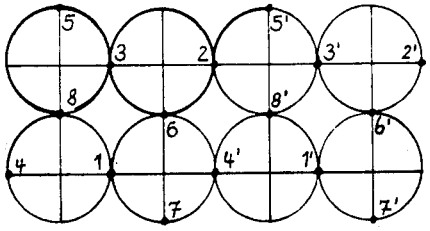
Figure 13H:
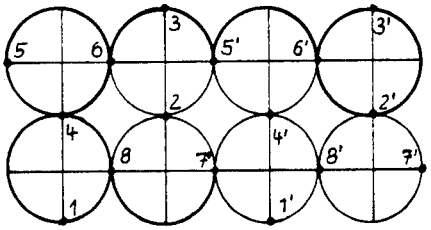
Figure 13I:
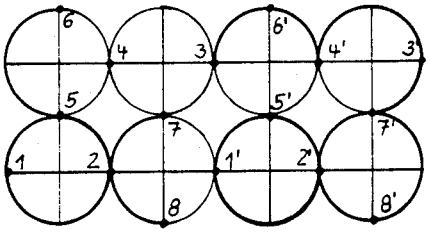

FIG. 13(A) illustrates a unit comprising two braiding heads 10 and 20 for the manufacture of two eight-threaded net shanks. Braiding head 10 is provided with the bobbin pairs 1', 2' to 7', 8'.

Each braiding head comprises four squarely arranged flyer wheels 11, 12, 13, 14 (braiding head 10) and 21, 22, 23, 24 (braiding head 20) (quadruple flyer wheel principle). The diagonally opposite flyer wheels (11, 13 and 12, 14 of the braiding head 10 as well as 21, 23 and 22, 24 of braiding head 20) form the figure 8-shaped paths in which the bobbin pairs revolve on braiding. The paths cross diagonally in each braiding head. Each flyer wheel is provided with four recesses 15 or 25 at right angles for receiving and transporting the bobbins.

The arrows illustrate the direction of revolution of the flyer wheels. Step-by-step manufacture (90° turns of the flyer wheels) of the figure 8-shaped net shanks is illustrated in the partial FIGS. 13(B) to 13(I). The individual partial figures illustrate the positions of the bobbins on both braiding heads 10 and 20 after one individual 90° turn of the flyer wheels. After eight steps (FIG.

13(I)) the bobbin pairs have again reached the initial position represented in FIG. 13(A), a braid in the net shank having been produced.

The initial position of the bobbin pairs for the manufacture of the net shanks also corresponds to the initial position of the bobbins for manufacture of the connection point between two eight-threaded net shanks (FIG. 14). FIG. 14(A) corresponds to FIG. 13(A).

According to the solution proposed by this invention, the switching of the pair of bobbins occurs in such a way that each pair of bobbins crosses to the adjoining braiding head over the corresponding flyer wheel, for instance the pairs of bobbins 1, 2 and 3, 4 cross over flyer wheel 21 and the pairs of bobbins 5, 6 and 7, 8 cross over flyer wheel 24 the pairs of bobbins 1',2' and 3',4' cross over flyer wheel 13 and the pairs of bobbins 5',6' and 7',8' cross over flyer wheel 12.

After each pair of bobbins has crossed to the adjoining braiding head over the corresponding flyer wheel, the braiding process is continued with the braiding head paths diagonally crossing each other.

Figure 14A:
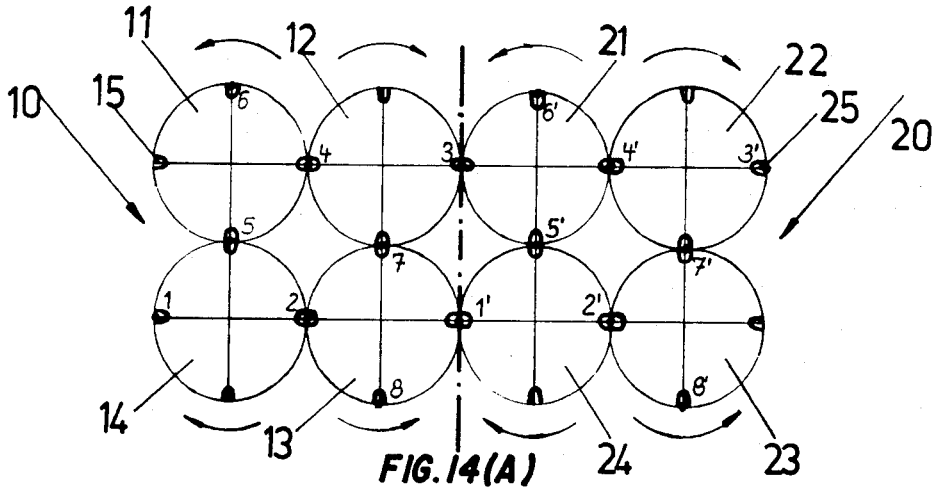
FIGS. 14(A)–(I) illustrate a braiding unit comprising two braiding heads and the step-by-step manufacture of the connection point.
Figure 14B:
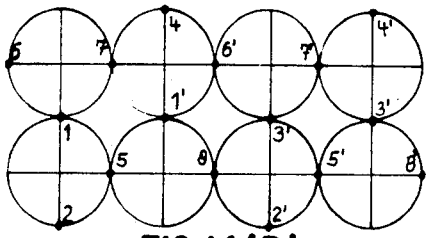
Figure 14C:
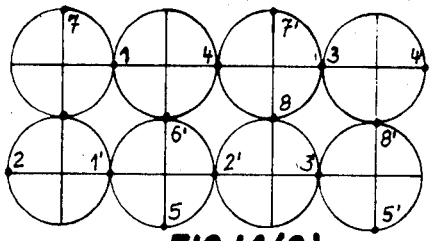
Figure 14D:
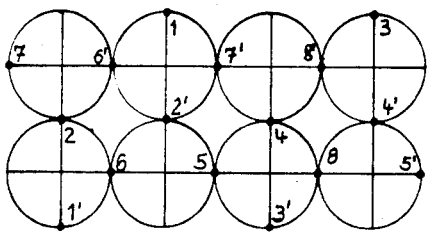
Figure 14E:
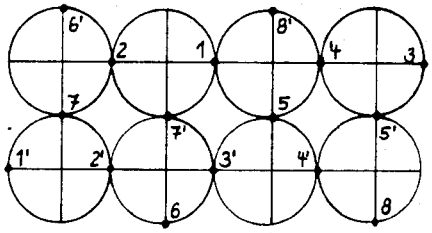
Figure 14F:
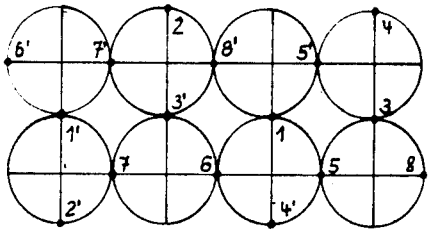
Figure 14G:
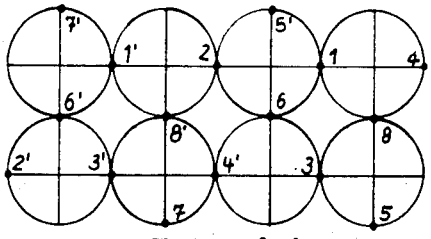
Figure 14H:
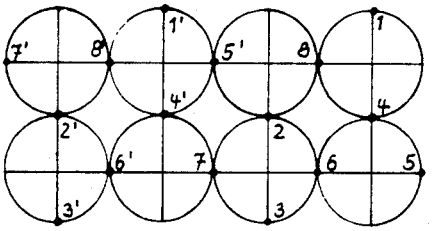
Figure 14I:
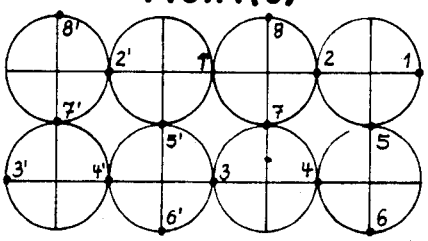

After eight steps, manufacture of the connection point is completed (FIG. 14(I)), the pairs of bobbins having assumed the initial position illustrated in FIG. 14(A).

We claim:

1. A method for fabricating three, four, six, or eight-threaded knotlessly braided nets according to the quadruple flyer wheel principle, comprising (A) aligning a plurality of flyer wheels to form a braiding head, (B) arranging two such braiding heads adjacent to one another, with a pair of flyer wheels of one braiding head adjoining a pair of flyer wheels of the adjacent braiding head, (C) positioning bobbins upon recesses formed at discrete intervals along said flyer wheels, (D) rotating said bobbins about said flyer wheels to diagonally pass from one flyer wheel to another flyer wheel of a braiding head in a figure-eight-shaped path, weaving a net shank, and (E) forming a connection point between net shanks by shifting said bobbins from one braiding head to an adjacent braiding head through adjoining flyer wheels.

2. The method of claim 1 for fabricating a triple-threaded, knotlessly braided net, comprising the steps of, (A) arranging two flyer wheels adjacent to one another to form a braiding head, each flyer wheel provided with four recesses about its circumference at approximate 90° intervals, (B) forming a second brading head in the same fashion as braiding head (A), (C) aligning said two braiding head next to one another, with each flyer wheel of one braiding head adjoining a corresponding flyer wheel of an adjacent braiding head, (D) positioning three bobbins in the recesses on the flyer wheels of each braiding head, with two bobbins on one flyer wheel and the third bobbin on an adjacent flyer wheel in the same braiding head, (E) rotating said bobbins about the adjacent flyer wheels in each braiding head to diagonally pass between adjacent flyer wheels in each braiding head in a figure-eight-shaped path to form a net shank within eight approximate 90° rotations of the flyer wheels, (F) realigning said bobbins with all three bobbins on a flyer wheel of one braiding head which is diagonally opposite a flyer wheel containing all three bobbins on the adjacent braiding head, and (G) rotating said bobbins about both said braiding heads to fabricate a connection point between the net shanks of the adjacent braiding heads within two approximate 90° rotations of said flyer wheels.

3. The method of claim 1 for fabricating a quadruple-threaded, knotlessly braided net, comprising the steps of (A) arranging four flyer wheels adjacent to one another in approximately square fashion to form a braiding head, each flyer wheel provided with three recesses about its circumference at approximate 120° intervals, (B) forming a second braiding head in the same fashion as braiding head (A), (C) aligning said two braiding heads next to one another, with two of said flyer wheels of one braiding head each adjoining a corresponding flyer wheel of an adjacent braiding head, (D) positioning four bobbins in the recesses on the flyer wheels of each braiding head, with one bobbin on each flyer wheel, (E) rotating said bobbins about the adjacent flyer wheels in each braiding head to diagonally pass between adjacent flyer wheels in each braiding head in a figure-eight-shaped path to form a net shank within six approximate 120° rotations of the flyer wheels, and (F) rotating said bobbins about both said braiding heads in figure-eight-shaped fashion to fabricate a connection point between the net shanks of the adjacent braiding heads within five approximate 120° rotations of the flyer wheels.

4. The method of claim 1 for fabricating a six-threaded, knotlessly braided net, comprising the steps of (A) arranging four flyer wheels adjacent to one another in approximately square fashion to form a braiding head, each flyer wheel provided with four recesses about its circumference at approximate 90° intervals, (B) forming a second braiding head in the same fashion as braiding head (A), (C) aligning said two braiding heads next to one another, with two of said flyer wheels of one braiding head each adjoining a corresponding flyer wheel of an adjacent braiding head, (D) positioning six bobbins in the recesses on the flyer wheels of each braiding head, with a pair of bobbins on a flyer wheel which is diagonally opposite a flyer wheel containing a pair of bobbins, and a single bobbin on a flyer wheel which is diagonally opposite a flyer wheel containing a single bobbin, (E) rotating said bobbins about the adjacent flyer wheels in each braiding head to diagonally pass between adjacent flyer wheels in each braiding head in a figure-eight-shaped path to form a net shank within eight approximate 90° rotations of the flyer wheels, and (F) rotating said bobbins about both said braiding heads in figure-eight-shaped fashion to fabricate a connection point between the net shanks of the adjacent braiding heads within six approximate 90° rotations of the flyer wheels.

5. The method of claim 1 for fabricating a six-threaded, knotlessly braided net, comprising the steps of (A) arranging four flyer wheels adjacent to one another in approximately square fashion to form a braiding head, each flyer wheel provided with three recesses about its circumference at approximate 120° intervals, (B) forming a second braiding head in the same fashion as braiding head (A), (C) aligning said two braiding heads next to one another, with two of said flyer wheels of one braiding head each adjoining a corresponding flyer wheel of an adjacent braiding head, (D) positioning six bobbins in the recesses on the flyer wheels of each braiding head, with a pair of bobbins on a flyer wheel which is diagonally opposite a flyer wheel contining a pair of bobbins, and a single bobbin on a flyer wheel which is diagonally opposite a flyer wheel containing a single bobbin, (E) rotating said bobbins about the adjacent flyer wheels in each braiding head to diagonally pass between adjacent flyer wheels in each braiding head in a figure-eight-shaped path to form a net shank within six approximate 120° rotations of the flyer wheels, and (F) rotating said bobbins about both said braiding heads in figure-eight-shaped fashion to fabricate a connection point between the net shanks of the adjacent braiding heads within five approximate 120° rotations of the flyer wheels.

6. The method of claim 1 for fabricating an eight-threaded, knotlessly braided net, comprising the steps of (A) arranging four flyer wheels adjacent to one another in approximately square fashion to form a braiding head, each flyer wheel provided with four recesses about its circumference at approximate 90° intervals, (B) forming a second braiding head in the same fashion as braiding head (A), (C) aligning said two braiding heads next to one another, with two of said flyer wheels of one braiding head each adjoining a corresponding flyer wheel of an adjacent braiding head, (D) positioning eight bobbins in the recesses on the flyer wheels of each braiding head, with a pair of bobbins on each flyer wheel, (E) rotating said bobbins about the adjacent flyer wheels in each braiding head to diagonally pass between adjacent flyer wheels in each braiding head in a figure-eight-shaped path to form a net shank within eight approximate 90° rotations of the flyer wheel, and (F) rotating said bobbins about both said braiding heads in figure-eight-shaped fashion to fabricate a connection poaint between the net shanks of the adjacent braiding heads within eight approximate 90° rotations of the flyer wheels.

7. A method for fabricating three, four, six, or eight-threaded knotlessly braided nets according to the quadruple flyer wheel principle, comprising (A) aligning a plurality of flyer wheels to form a braiding head, (B) arranging two such braiding heads adjacent to one another, with a pair of flyer wheels of one braiding head adjoining a pair of flyer wheels of the adjacent braiding head, (C) positioning bobbins upon recesses formed at discrete intervals along said flyer wheels, and (D) rotating said bobbins about said flyer wheels to diagonally pass from one flyer wheel to another flyer wheel of a braiding head in a figure-eight-shaped path, and weaving a net shank.

8. The method of claim 7 for fabricating a triple-threaded, knotlessly braided net, comprising the steps of, (A) arranging two flyer wheels adjacent to one another to form a braiding head, each flyer wheel provided with four recesses about its circumference at approximate 90° intervals, (B) forming a second braiding head in the same fashion as braiding head (A), (C) aligning said two braiding heads next to one another, with each flyer wheel of one braiding head adjoining a corresponding flyer wheel of an adjacent braiding head, (D) positioning three bobbins in the recesses on the flyer wheels if each braiding head, with two bobbins one one flyer wheel and the third bobbin on an adjacent flyer wheel in the same braiding head, and (E) rotating said bobbins about the adjacent flyer wheels in each braiding head to diagonally pass between adjacent flyer wheels in each braiding head in a figure-eight-shaped path to form a net shank within eight approximate 90° rotations of the flyer wheels.

9. The method of claim 7 for fabricating a quadruple-threaded, knotlessly braided net, comprising the steps of (A) arranging four flyer wheels adjacent to one another in approximately square fashion to form a braiding head, each flyer wheel provided with three recesses about its circumference at approximate 120° intervals, (B) forming a second braiding head in the same fashion as braiding head (A), (C) aligning said two braiding heads next to one another, with two of said flyer wheels of one braiding head each adjoining a corresponding flyer wheel of an adjacent braiding head, (D) positioning four bobbins in the recesses on the flyer wheels of each braiding head, with one bobbin on each flyer wheel, and (E) rotating said bobbins about the adjacent flyer wheels in each braiding head to diagonally pass between adjacent flyer wheels in each braiding head in a figure-eight-shaped path to form a net shank within six approximate 120° rotations of the flyer wheels.

10. The method of claim 7 for fabricating a six-threaded, knotlessly braided net, comprising the steps of (A) arranging four flyer wheels adjacent to one another in approximately square fashion to form a braiding head, each flyer wheel provided with four recesses about its circumference at approximate 90° intervals, (B) forming a second braiding head in the same fashion as braiding head (A), (C) aligning said two braiding heads next to one another, with two of said flyer wheels of one braiding head each adjoining a corresponding flyer wheel of an adjacent braiding head, (D) positioning six bobbins in the recesses on the flyer wheels of each braiding head, with a pair of bobbins on a flyer wheel which is diagonally opposite a flyer wheel containing a pair of bobbins, and a single bobbin on a flyer wheel which is diagonally opposite a flyer wheel containing a single bobbin, and (E) rotating said bobbins about the adjacent flyer wheels in each braiding head to diagonally pass between adjacent flyer wheels in each braiding head in a figure-eight-shaped path to form a net shank within eight approximate 90° rotations of the flyer wheels.

11. The method of claim 7 for fabricating a six-threaded, knotlessly braided net, comprising the steps of (A) arranging four flyer wheels adjacent to one another in approximately square fashion to form a braiding head, each flyer wheel provided with three recesses about its circumference at approximate 120° intervals, (B) forming a second braiding head in the same fashion as braiding head (A), (C) aligning said two braiding heads next to one another, with two of said flyer wheels of one braiding head each adjoining a corresponding flyer wheel of an adjacent braiding head, (D) positioning six bobbins in the recesses on the flyer wheels of each braiding head, with a pair of bobbins on a flyer wheel which is diagonally opposite a flyer wheel containing a pair of bobbins, and a single bobbin on a flyer wheel which is diagonally opposite a flyer wheel containing a single bobbin, and (E) rotating said bobbins about the adjacent flyer wheels in each braiding head to diagonally pass between adjacent flyer wheels in each braiding head in a figure-eight-shaped path to form a net shank within six approximate 120° rotations of the flyer wheels.

12. The method of claim 7 for fabricating an eight-threaded, knotlessly braided net, comprising the steps of (A) arranging four flyer wheels adjacent to one another in approximately square fashion to form a braiding head, each flyer wheel provided with four recesses about its circumference at approximate 90° intervals, (B) forming a second braiding head in the same fashion as braiding head (A), (C) aligning said two braiding heads next to one another, with two of said flyer wheels of one braiding head each adjoining a corresponding flyer wheel of an adjacent braiding head, (D) positioning eight bobbins in the recesses on the flyer wheels of each braiding head, with a pair of bobbins on each flyer wheel, and (E) rotating said bobbins about the adjacent flyer wheels in each braiding head to diagonally pass between adjacent flyer wheels in each braiding head in a figure-eight-shaped path to form a net shank within eight approximate 90° rotations of the flyer wheel.

* * * * *